US010900197B2

(12) United States Patent
Futakami

(10) Patent No.: US 10,900,197 B2
(45) Date of Patent: Jan. 26, 2021

(54) WORK MACHINE MANAGEMENT APPARATUS

(71) Applicant: Komatsu Ltd., Tokyo (JP)

(72) Inventor: Masanao Futakami, Minato-ku (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 15/557,624

(22) PCT Filed: Mar. 29, 2017

(86) PCT No.: PCT/JP2017/013045
§ 371 (c)(1),
(2) Date: Sep. 12, 2017

(87) PCT Pub. No.: WO2017/183404
PCT Pub. Date: Oct. 26, 2017

(65) Prior Publication Data

US 2020/0024825 A1 Jan. 23, 2020

(51) Int. Cl.
*E02F 3/96* (2006.01)
*E02F 9/20* (2006.01)
(Continued)

(52) U.S. Cl.
CPC ..... *E02F 3/96* (2013.01); *E02F 9/2025* (2013.01); *E02F 9/2221* (2013.01);
(Continued)

(58) Field of Classification Search
CPC ..... E02F 3/96; E02F 9/2025; E02F 9/2221; E02F 9/2246; E02F 9/26; E02F 29/04
(Continued)

(56) References Cited

U.S. PATENT DOCUMENTS 5,970,436 A 10/1999 Berg et al.
2002/0083825 A1* 7/2002 Kusuyama ..... E02F 9/2228 91/461
(Continued)

FOREIGN PATENT DOCUMENTS

CN 1875386 12/2006
CN 101107400 1/2008
(Continued)

OTHER PUBLICATIONS

International Search Report and Written Opinion for International Application No. PCT/JP2017/013045, dated May 30, 2017, 8 pages (English translation).
(Continued)

*Primary Examiner* — Tan Q Nguyen
(74) *Attorney, Agent, or Firm* — Fish & Richardson P.C.

(57) ABSTRACT

A work machine management apparatus includes: a working element identification information acquiring unit acquiring working element identification information indicating replacement of a working element; a flow rate setpoint acquiring unit acquiring a flow rate setpoint of a hydraulic oil for the working element; a pressure setpoint acquiring unit acquiring a pressure setpoint of the hydraulic oil for the working element; a working element operation information acquiring unit acquiring the acquired flow rate setpoint, the acquired pressure setpoint and operation information of the working element; and a working element actual operation information calculator calculating actual operation information containing an actual operation duration of the working element based on the information acquired by each of the working element identification information acquiring unit, the flow rate setpoint acquiring unit, the pressure setpoint acquiring unit and the working element operation information acquiring unit.

15 Claims, 9 Drawing Sheets

(51) Int. Cl.
*E02F 9/26* (2006.01)
*E02F 9/22* (2006.01)
*F02D 29/04* (2006.01)

(52) U.S. Cl.
CPC ..... *E02F 9/2246* (2013.01); *E02F 9/26* (2013.01); *F02D 29/04* (2013.01)

(58) Field of Classification Search
USPC ..... 701/50
See application file for complete search history.

(56) References Cited

U.S. PATENT DOCUMENTS

| | | | | |
|---|---|---|---|---|
| 2007/0094055 | A1 | 4/2007 | Nakayama et al. | |
| 2008/0300757 | A1 | 12/2008 | Kanayama et al. | |
| 2009/0199552 | A1* | 8/2009 | Abe | F15B 11/024 60/428 |
| 2009/0244106 | A1* | 10/2009 | Kuwae | E02F 9/16 345/690 |
| 2010/0185335 | A1* | 7/2010 | Sawada | E02F 3/3622 700/282 |
| 2012/0197465 | A1* | 8/2012 | Gotou | E02F 9/2246 701/2 |
| 2013/0325268 | A1* | 12/2013 | Ishihara | E02F 9/2246 701/50 |
| 2014/0052299 | A1* | 2/2014 | Suzuki | E02F 9/267 700/275 |
| 2016/0091002 | A1* | 3/2016 | Miura | E02F 3/96 60/459 |

FOREIGN PATENT DOCUMENTS

| | | |
|---|---|---|
| CN | 103384746 | 11/2013 |
| CN | 103502539 | 1/2014 |
| JP | H11-100869 | 4/1999 |
| JP | 2001173023 | 6/2001 |
| JP | 2002-302967 | 10/2002 |
| JP | 2003-034954 | 2/2003 |
| JP | 2006022563 | 1/2006 |
| JP | 2012-180683 | 9/2012 |
| JP | 2012-233336 | 11/2012 |
| JP | 2016070004 | 5/2016 |
| JP | 6085710 | 2/2017 |
| KR | 1020120063497 | 6/2012 |

OTHER PUBLICATIONS

PCT International Preliminary Report on Patentability in International Appln. No. PCT/JP2017/013045, dated Oct. 1, 2019, 1 page (English translation).
International Search Report and Written Opinion for International Application No. PCT/JP2017/013045, dated May 30, 2017, 10 pages.
Chinese Office Action in Chinese Application No. 201780000918.8, dated Sep. 12, 2019, 14 pages (with English Translation).
Korean Office Action in Korean Application No. KR10-2017-7024028, dated Nov. 12, 2018, 19 pages with English Translation.
Japanese Notice of Reason(s) of Rejection in Japanese Application No. JP2017-538450, dated Sep. 18, 2018, 10 pages.

* cited by examiner

10

12R
12L
13A
16
CONTROLLER
12A
12C
12C
6A (7A, 8A)
8C
12B
15
12
13
11B
11
11A
14
18
MULTIMONITOR

WORK MACHINE MANAGEMENT APPARATUS

TECHNICAL FIELD

The invention relates to a work machine management apparatus.

BACKGROUND ART

Work machines such as a hydraulic excavator are usually attached with, for instance, a bucket as working equipment. Such working equipment is removable from the work machines so that the work machines are attached with another attachment, such as a breaker, a grabber and a cutter, to perform works such as crushing concrete or the like, carrying wood or the like, and demolition.

For such attachment-attachable work machines, disclosed is a technique that information containing a type of the attached attachment and the location where the attachment is used is externally outputted via a satellite communication network (see, for instance, Patent Literature 1).

According to Patent Literature 1, such a technique advantageously enables a service person of a manufacturer to remotely access, for instance, the information of an attachment attached to a work machine so that the service person can provide a service needed by an operator.

CITATION LIST

Patent Literature(S)

Patent Literature 1: JP 2003-034954 A

SUMMARY OF THE INVENTION

Problem(s) to be Solved by the Invention

The technique of Patent Literature 1, however, enables the service person to know the type of the attachment in use and the location where the attachment is used, but not the condition where the attachment is used.

Especially, there are many types of attachment, some of which may put an excessive load on a work machine body depending on the flow rate of a hydraulic oil, pressure and the like for actuating the attachment.

An object of the invention is to provide a work machine management apparatus for a work machine attachable with an attachment, the apparatus being configured to recognize a load on the work machine due to actuating the attachment and the frequency of use of the attachment.

Means for Solving the Problem(s)

According to an aspect of the invention, a work machine management apparatus for a work machine, the work machine including: a work machine body including a carriage; and working equipment including a plurality of working elements movably connected to the work machine body, the working elements including at least one working element replaceable with a different working element, the work machine management apparatus includes: a working element identification information acquiring unit configured to acquire working element identification information indicating whether or not the replaceable working element is replaced with the different working element; a flow rate setpoint acquiring unit configured to acquire a flow rate setpoint of a hydraulic oil for the different working element; a pressure setpoint acquiring unit configured to acquire a pressure setpoint of the hydraulic oil for the different working element; a working element operation information acquiring unit configured to acquire the acquired flow rate setpoint, the acquired pressure setpoint and operation information of the different working element; and a working element actual operation information calculator configured to calculate actual operation information containing an actual operation duration of the different working element based on the information acquired by each of the working element identification information acquiring unit, the flow rate setpoint acquiring unit, the pressure setpoint acquiring unit and the working element operation information acquiring unit.

In the above aspect of the invention, the working element identification information acquiring unit, the flow rate setpoint acquiring unit, the pressure setpoint acquiring unit and the working element operation information acquiring unit serve to recognize the usage condition of the working element, based on which the frequency of use of the working element and a load on the work machine due to the actuation can be recognized.

BRIEF DESCRIPTION OF DRAWING(S)

FIG. 1 is a perspective view showing a structure of a hydraulic excavator according to an exemplary embodiment of the invention.

FIG. 2 schematically shows a hydraulic system for the hydraulic excavator according to the exemplary embodiment.

FIG. 3 schematically shows an overall arrangement of a management system including a work machine management apparatus according to the exemplary embodiment.

FIG. 4 schematically shows an image displayed on a multimonitor according to the exemplary embodiment.

Figure 8:
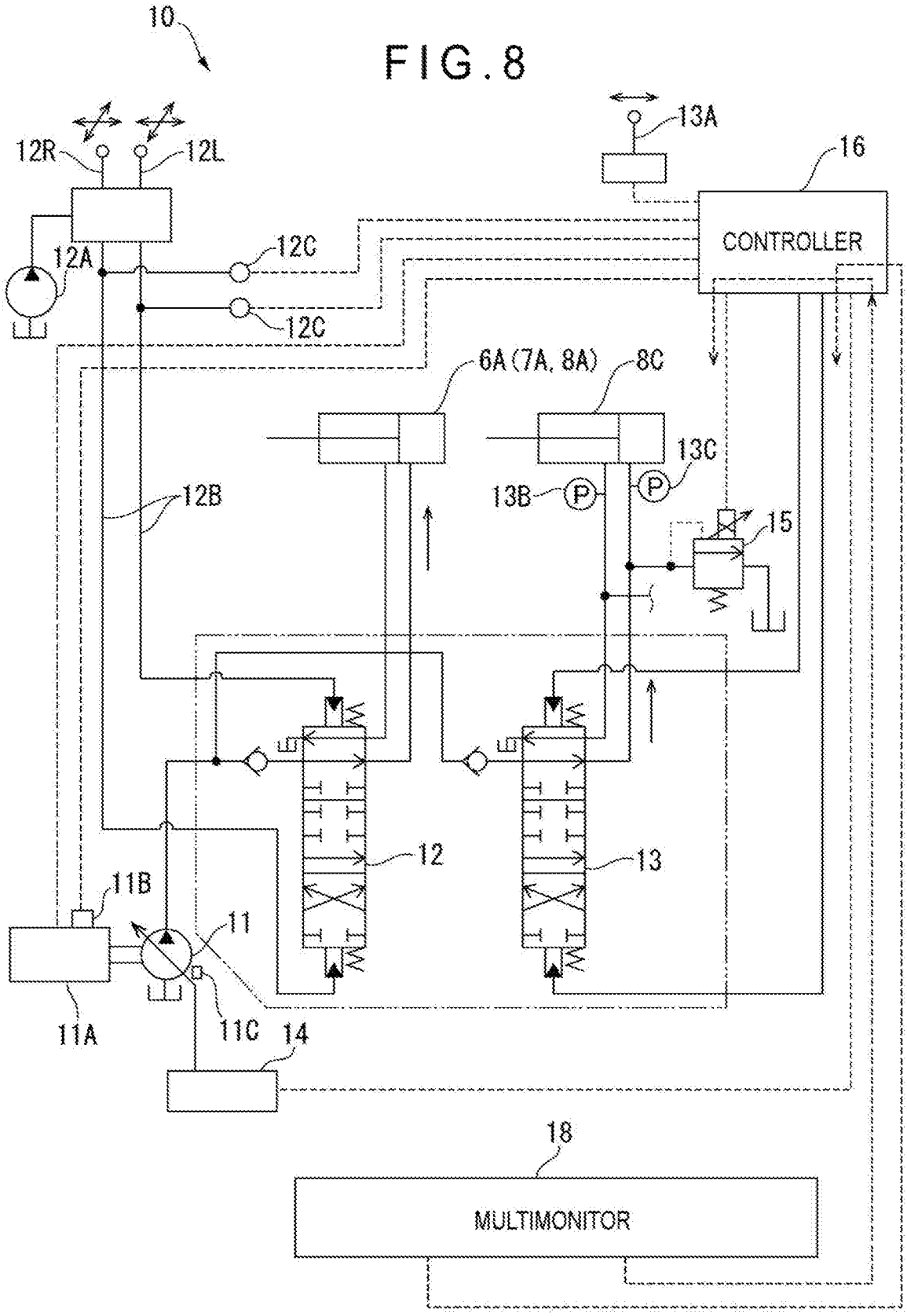

FIG. 8 schematically shows a hydraulic system for a hydraulic excavator according to a third exemplary embodiment of the invention.

Figure 9:
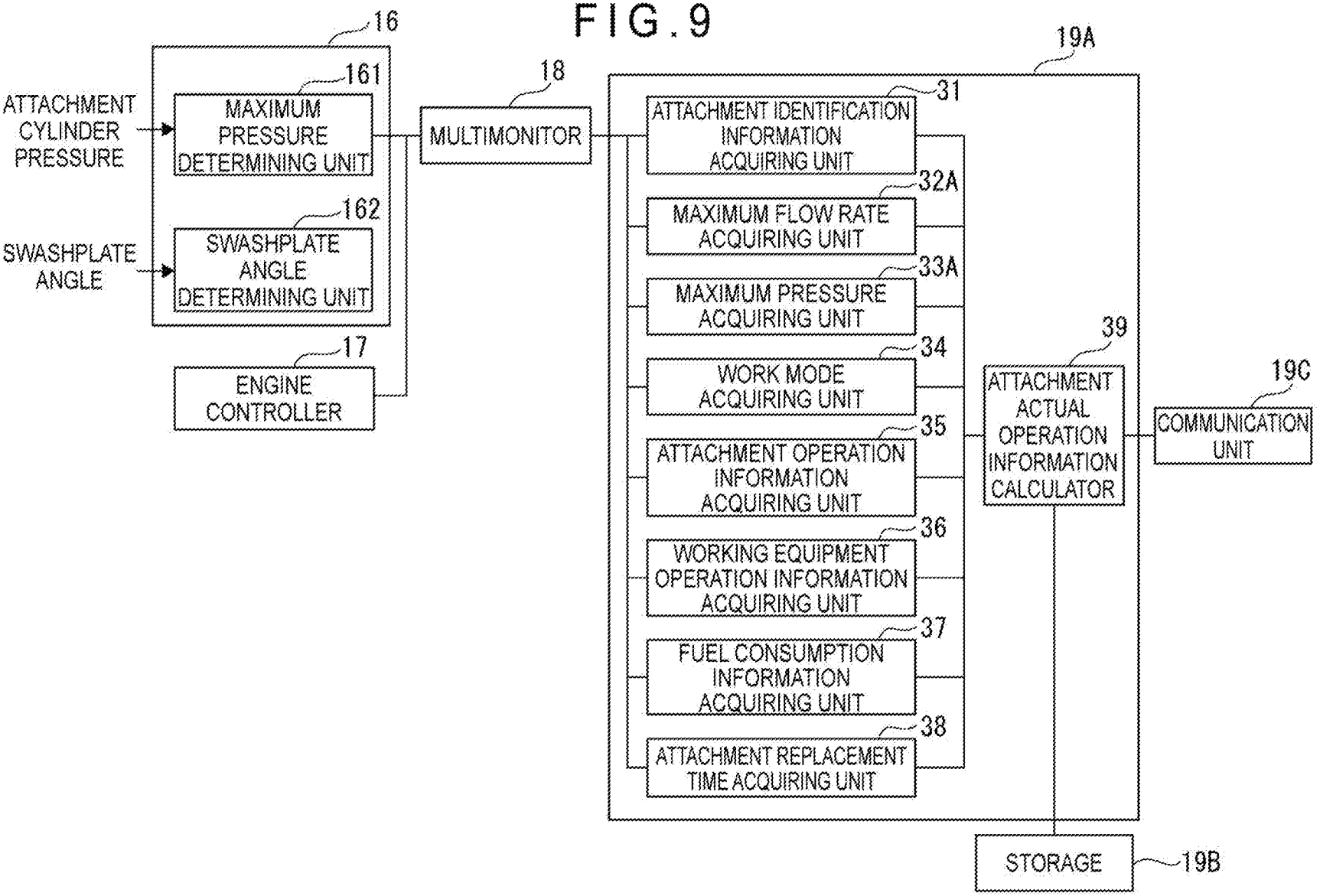

FIG. 9 is a block diagram showing the work machine management apparatus according to the exemplary embodiment.

DESCRIPTION OF EMBODIMENT(S)

Exemplary embodiment(s) of the invention will be described below with reference to the attached drawings.

First Exemplary Embodiment

[1] Overall Arrangement

Figure 1:
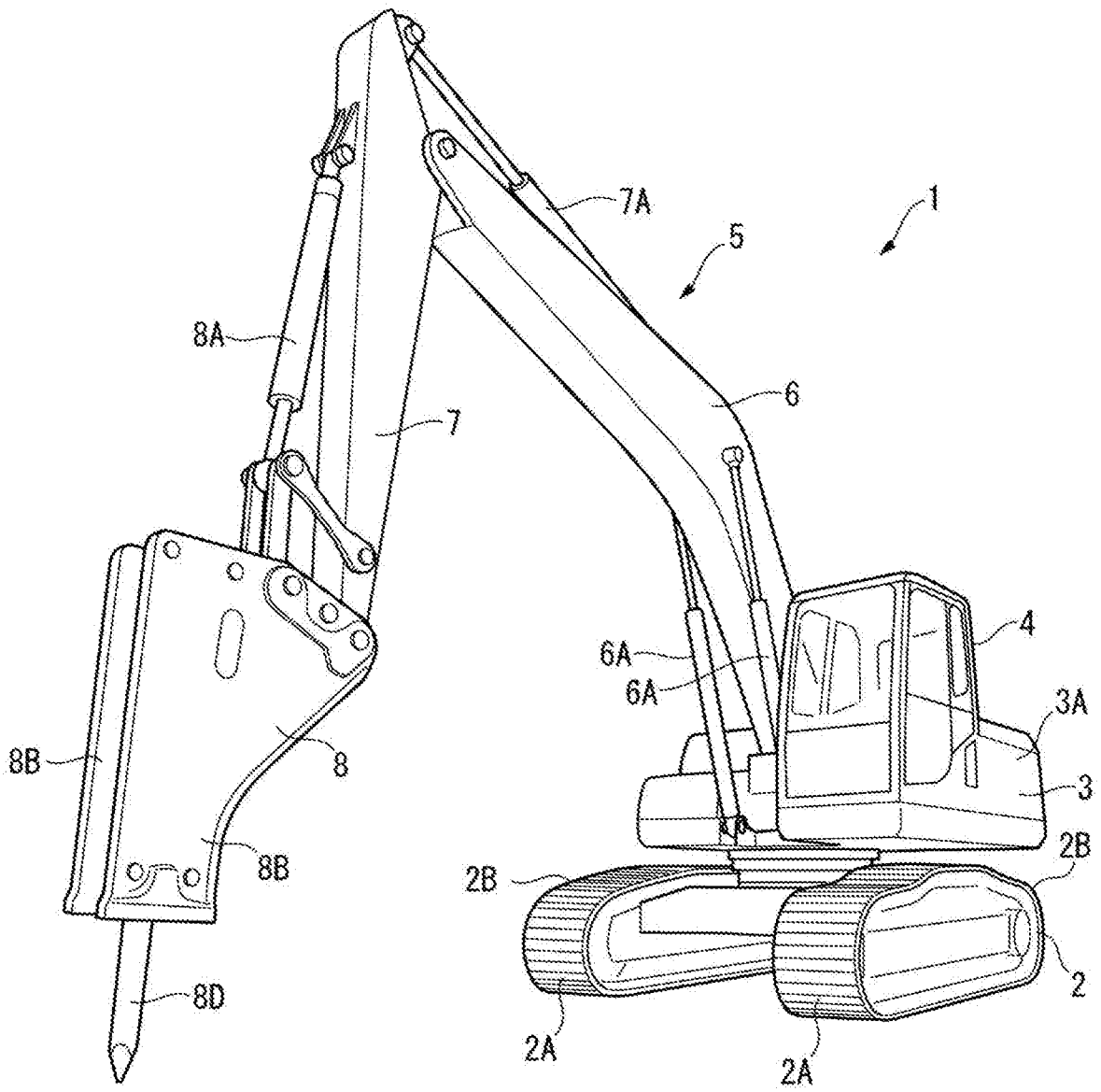

FIG. 1 shows a structure of a hydraulic excavator 1 according to an exemplary embodiment of the invention. The hydraulic excavator 1 includes an undercarriage 2, an upper structure 3 and working equipment 5. It should be noted that, in the description of the drawings, a vehicle front-back direction, a vehicle width direction and a vehicle vertical direction for an operator in a normal operation attitude of the hydraulic excavator 1 will be respectively simply referred to as a front-back direction, a right-left direction and a vertical direction.

The undercarriage 2 (i.e., work machine body) includes a truck frame (not shown) and a pair of crawler units 2A located in a vehicle width direction of the truck frame. Each of the crawler units 2A, which includes a crawler belt 2B wrapped around driving wheel and idle wheel provided to the truck frame, is configured to move forward and backward in an extension direction of the crawler belt 2B when the driving wheel is driven by a hydraulic motor.

The upper structure 3 (i.e., work machine body) is swingably mounted on the truck frame of the undercarriage 2 via a swing circle. The upper structure 3 is provided with a cab 4 at the front left thereof in a travel direction and the working equipment 5 at the front center thereof adjacently to the cab 4. The upper structure 3 is also provided with a counterweight 3A at the rear thereof opposite to the cab 4 and the working equipment 5. The counterweight 3A is configured to balance the hydraulic excavator 1 in weight during an excavation work.

An operator is seated in the cab 4 to operate the hydraulic excavator 1. The cab 4 is provided therein with an operator seat, right and left control levers 12R, 12L (see FIG. 2) at the right and left sides of the operator seat, and a travel pedal on a floor surface of the cab 4, which are not shown.

The working equipment 5 includes working elements such as a boom 6, an arm 7 and an attachment or bucket. In the exemplary embodiment to be described, the replaceable attachment is, for instance, a breaker 8. A boom cylinder 6A, an arm cylinder 7A and a bucket cylinder 8A are also provided to actuate the working elements. The working elements may further include more operation elements as needed.

The boom 6 is movably connected to the upper structure 3. The boom cylinder 6A is connected to the upper structure 3 and the boom 6. Extension and retraction of the boom cylinder 6A cause the boom 6 to move up and down relative to the upper structure 3.

The arm 7 has a base end movably connected to the distal end of the boom 6. The arm cylinder 7A is connected to the middle of the boom 6. Extension and retraction of the arm cylinder 7A cause the arm 7 to move up and down relative to the boom 6.

The bucket (not shown) is usually movably connected to the distal end of the arm 7. The arm 7 has a base end connected to the bucket cylinder 8A. Extension and retraction of the bucket cylinder 8A cause the bucket to move relative to the arm 7, performing excavation and dumping. The distal end of the arm 7 is replaceably attachable with an attachment different from the bucket, an example of which is the breaker 8 according to the exemplary embodiment.

The breaker 8 is an attachment attachable in place of the bucket that is usually attached. Extension and retraction of the bucket cylinder 8A, which is connected to the arm 7 and the breaker 8, cause the breaker 8 to move up and down.

The breaker 8 includes a pair of brackets 8B connected to the bucket cylinder 8A, an attachment cylinder 8C (not shown in FIG. 1 but see FIG. 2) located between the pair of brackets 8B, and a chisel 8D projecting from the distal end of the attachment cylinder 8C. The attachment cylinder 8C of the breaker 8 is supplied with a hydraulic oil through a pipe (not shown) located along the boom 6 and the arm 7.

The hydraulic oil supplied to the attachment cylinder 8C causes extension and retraction of a piston of the attachment cylinder 8C and, consequently, causes a periodic repeat of projection and retraction of the chisel 8D relative to the bracket 8B. Concrete or the like is thus hit and stuck with the chisel 8D to be crushed.

Figure 2:
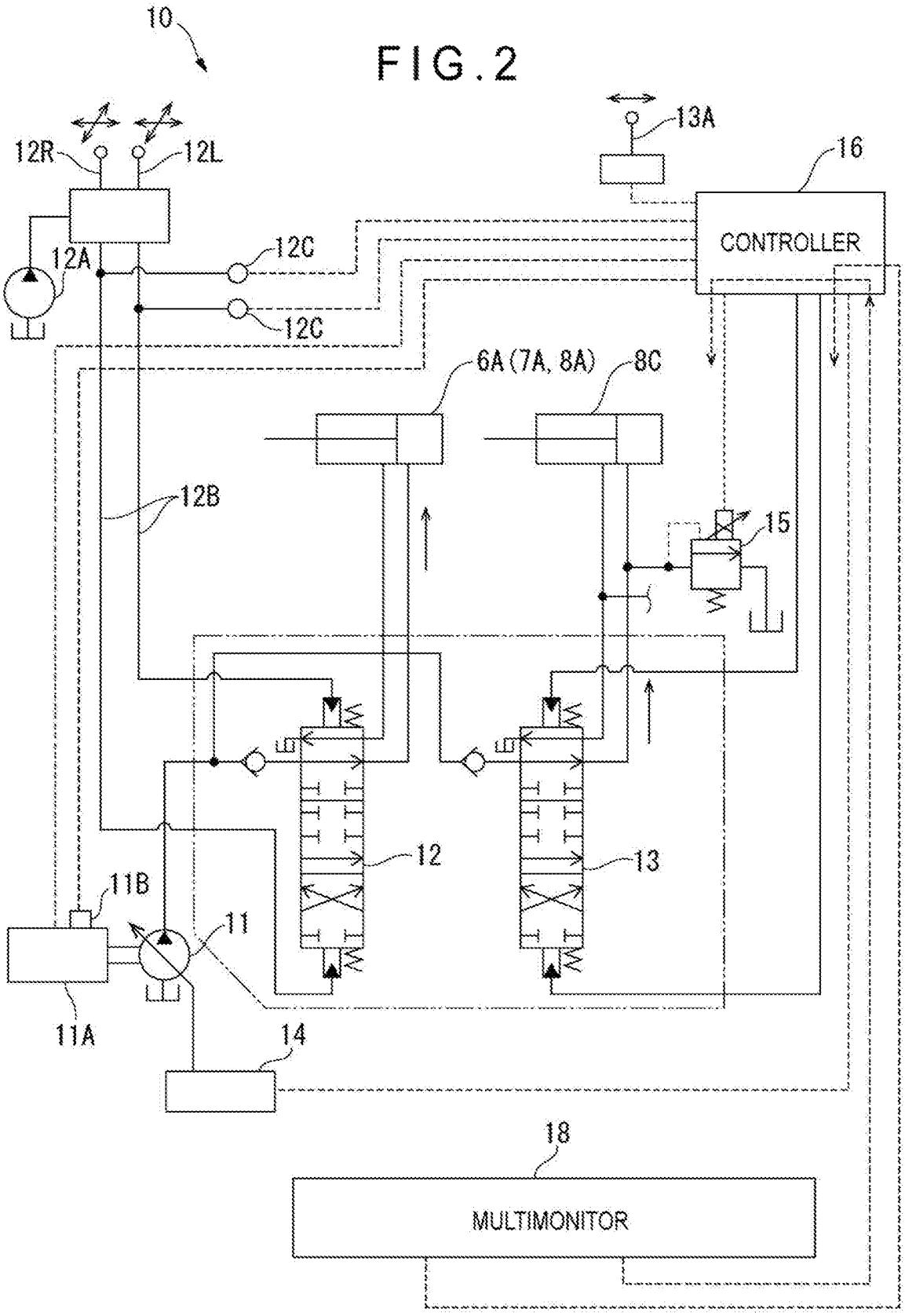

The breaker 8 is itself actuated by the bucket cylinder 8A, increasing the drive axes of the chisel 8D in a hit-and-stick direction with the assistance of an attachment valve 13 (see FIG. 2). It should be noted that the breaker 8 is used in the exemplary embodiment, but any attachment different from the breaker 8, such as a grabber for grabbing an object, a tilt bucket movable around another drive axis as compared with a bucket, and a cutter for cutting an object, may also be available.

[2] Arrangement of Hydraulic System 10

FIG. 2 shows a hydraulic system 10 of the hydraulic excavator 1. A hydraulic circuit of the hydraulic system 10 includes the hydraulic cylinders 6A, 7A, 8A, the attachment cylinder 8C, a hydraulic pump 11, a main valve 12, a pilot hydraulic pump 12A, a pilot line 12B, a pressure sensor 12C, the attachment valve 13, a pump-flow control unit 14 and an electromagnetic variable relief valve 15. Further, the hydraulic system 10 includes an engine 11A, the control levers 12R, 12L, an attachment control lever 13A, a pump controller 16, an engine controller 17 (see FIG. 3) and a multimonitor 18.

The engine 11A, which is a drive source for driving a work machine, is a diesel engine or the like. The drive source may also be an electric motor designed to be driven by a storage capacitor. The drive source may be a combination of an electric motor and a diesel engine. A sensor 11B, which is provided to the engine 11A, is configured to detect the rotation speed of the engine 11A and output a detection value to the engine controller 17.

The hydraulic pump 11 is a variable displacement hydraulic pump such as a swashplate hydraulic pump. The hydraulic pump 11 serves as a hydraulic oil supply source for delivering the hydraulic oil to the main valve 12 and the attachment valve 13.

The hydraulic pump 11 is driven by the engine 11A and operates in accordance with a control command from the pump controller 16.

The main valve 12 is a direction switching valve for discharging and delivering the hydraulic oil. The flow of the hydraulic oil is switched to cause extension and retraction of each of the boom cylinder 6A, the arm cylinder 7A and the bucket cylinder 8A of the working equipment 5. It should be noted that the main valve 12 includes valves (not shown in FIG. 2) connected one-to-one to the boom cylinder 6A, the arm cylinder 7A and the bucket cylinder 8A.

The main valve 12 is driven by a hydraulic pressure in the pilot line 12B including the pump 12A. Specifically, a driving command is outputted to a spool of the main valve 12 to change the position thereof by operating the right control lever 12R and the left control lever 12L in the cab 4.

The pressure sensor 12C is located in the pilot line 12B. The pressure sensor 12C is configured to output a detected pressure detection value to the pump controller 16.

A motion of the right control lever 12R in the front-back direction causes the boom 6 to move down and up. A motion of the right control lever 12R in the right-left direction causes the distal end of the breaker 8 to be directed forward and rearward. A motion of the left control lever 12L in the front-back direction causes a damping motion and an excavation motion of the arm 7. A motion of the left control lever 12L in the right-left direction causes a swing motion of the upper structure 3 in the right-left direction. The motion pattern of the working equipment 5 depending on the operation of the operation levers 12R, 12L is exemplary and may be determined as desired.

The electric attachment control lever 13A, which is an electric control lever, is configured to output a driving signal to the pump controller 16 in response to an operation inputted by an operator.

The attachment valve 13, which is a direction switch valve for discharging and delivering the hydraulic oil to the breaker 8, is configured to discharge and deliver the hydraulic oil independently of the main valve 12.

The position of the attachment valve 13 is changed in response to a driving command that is outputted to a spool of the attachment valve 13 through the pump controller 16 by operating the electric attachment control lever 13A.

The pump-flow control unit 14 is a driving mechanism including a solenoid proportional valve or a cylinder. A change in the opening degree of the pump-flow control unit 14 leads to a change in the swashplate angle of the hydraulic pump 11 and, consequently, a change in the flow rate of the hydraulic oil from the hydraulic pump 11.

The electromagnetic variable relief valve 15 is located on a branch of a pipe between the attachment valve 13 and the attachment cylinder 8C of the breaker 8. The opening degree of the electromagnetic variable relief valve 15 is adjusted to discharge a part of the hydraulic oil to be delivered to the breaker 8, thereby adjusting a pressure of the hydraulic oil applied to the breaker 8. In the exemplary embodiment, description is made on the assumption that the hydraulic circuit for operating the breaker 8 is in the form of a single system, but some types of attachment require two or more hydraulic systems and thus a plurality of hydraulic circuits may be prepared for such attachments.

The pump controller 16 receives a pilot signal inputted from the pressure sensor 12C and an operation signal from the attachment control lever 13A, and outputs a control signal to change the direction of each of the main valve 12 and the attachment valve 13. The pump controller 16 also outputs a control signal to the pump-flow control unit 14 and the electromagnetic variable relief valve 15 to control the opening degree of each of the pump-flow control unit 14 and the electromagnetic variable relief valve 15. The flow rate and pressure of the hydraulic oil to the breaker 8 are set by an operator through an operation on the multimonitor 18 located in the cab 4 and outputted as the control signal from the pump controller 16. It should be noted that the exemplary embodiment using the pilot hydraulic control levers 12L, 12R is described, but an electric lever configured to output to the pump controller 16 an electric signal corresponding to a lever inclination angle may alternatively be used.

[3] Arrangement of Management System for Hydraulic Excavator 1

Figure 3:
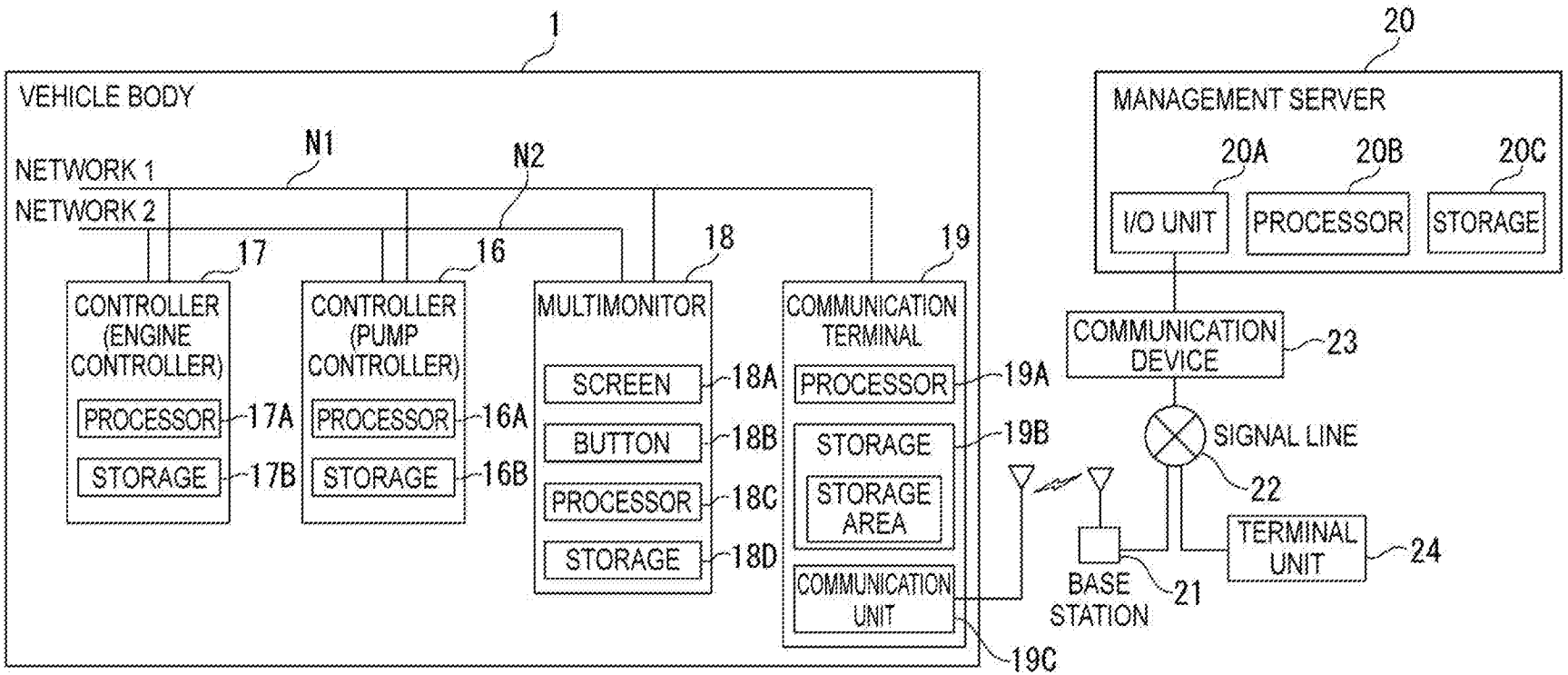

FIG. 3 shows a management system for the hydraulic excavator 1 according to the exemplary embodiment. The management system for the hydraulic excavator 1 includes the pump controller 16, the engine controller 17, the multimonitor 18 and a communication terminal 19, which are communicatively connected to one another through a network N1. Further, the pump controller 16, the engine controller 17 and the multimonitor 18 are communicatively connected to one another through a network N2. Each of the network N1 and the network N2 is a controller area network (CAN).

The pump controller 16, which receives an operation signal from the control levers 12R, 12L and outputs to the main valve 12, the attachment valve 13, the pump-flow control unit 14 and the electromagnetic variable relief valve 15 a control signal containing a driving command to the swashplate of the pump 11, includes a processor 16A including a central processing unit (CPU) and a storage 16B including a hard disk or an involatile memory.

The processor 16A of the pump controller 16 acquires detection data outputted from a temperature sensor, a pressure sensor and the like provided to the hydraulic system 10, and the data is stored in the storage 16B.

The processor 16A also outputs to the multimonitor 18 a control lever state for the working equipment 5, a travel control lever state and an attachment control lever state.

The engine controller 17, which outputs a control signal to the engine 11A of the hydraulic excavator 1, includes a processor 17A including a CPU and a storage 17B including a hard disk or an involatile memory. It should be noted that the engine controller 17 outputs an injection command to the engine 11A and receives information, such as a work mode, a fuel injection amount, an engine speed, an engine cooling water temperature and a residual fuel amount, inputted through the multimonitor 18.

The processor 17A of the engine controller 17 calculates an instant fuel consumption from the acquired fuel injection amount and acquires detection data outputted from a temperature sensor provided to the engine 11A or the like, and the calculation result and the data are stored in the storage 17B.

The processor 17A also outputs the instant fuel consumption of the engine 11A and the residual fuel amount to the multimonitor 18.

The multimonitor 18 displays the information from the various sensors acquired by the pump controller 16 and the engine controller 17 and is operated by an operator to change various control settings of the pump controller 16 and the engine controller 17.

The multimonitor 18 includes a screen 18A, a button 18B, a processor 18C including a CPU and a storage 18D including a hard disk or an involatile memory.

The screen 18A, which is a liquid crystal display or the like, displays a hydraulic oil temperature in the hydraulic system 10, a cooling water temperature in the engine 11A, a residual fuel amount and the like. The button 18B is a switch to be operated by an operator. The operator can switch the display on the screen 18A and/or change the various settings by operating the button 18B. It should be noted that a touch panel display may be used as the multimonitor 18 to allow direct input by an operation on the screen.

Figure 4:
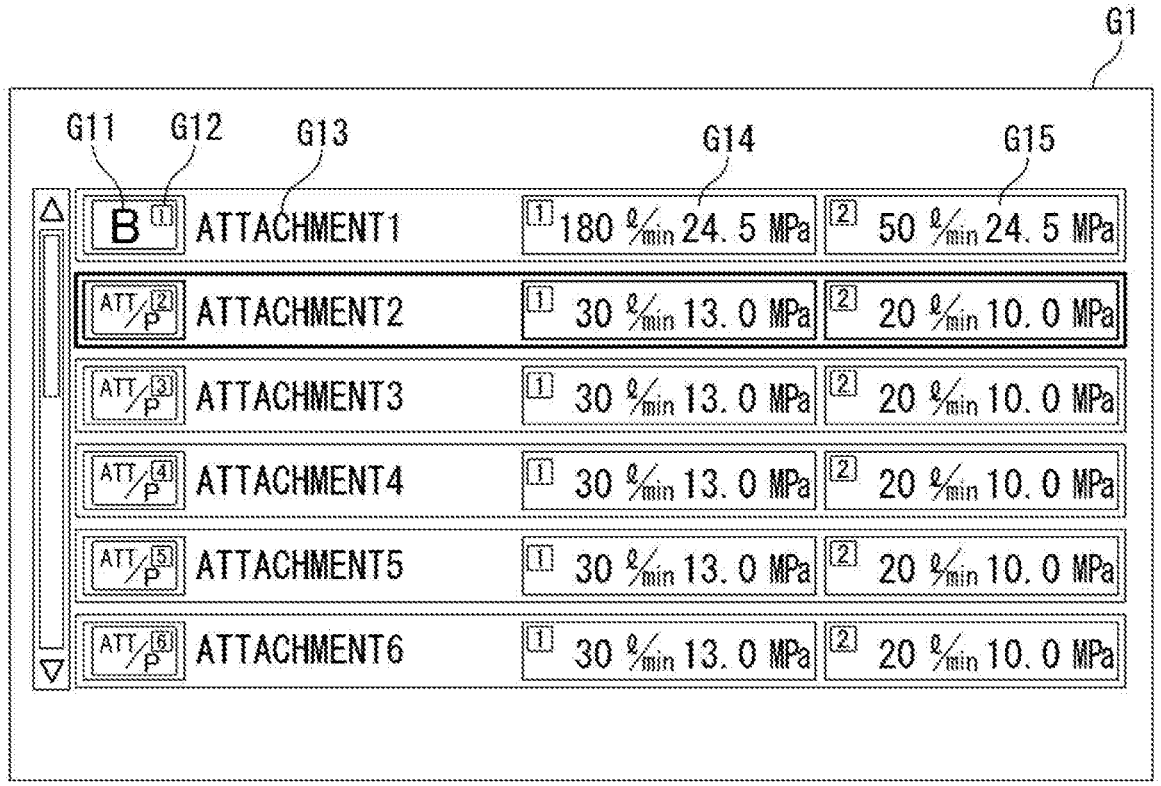

FIG. 4 shows setting information to be set based on an input from an operator. An image G1 for setting the setting information includes: an area G11 for inputting the work mode such as a power mode, an economy mode, a load-hanging mode and an attachment control mode; an area G12 for determining a work mode registration number corresponding to a preset number assigned to each attachment; an area G13 for inputting an attachment name; and areas G14, G15 for inputting a pressure setpoint and a flow rate setpoint. With such a plurality of areas G14, G15 for inputting, values can be independently set to the hydraulic circuit configured to actuate a plurality of attachments. The work mode registration number and the attachment name correspond to attachment identification information. The setting information includes a plurality of registrable information items. Such a plurality of registered information items are differentiated using different work mode registration numbers and switched upon replacement of the attachment.

The processor 18C sets the work mode, the work mode registration number, the attachment name, the pressure setpoint and the flow rate setpoint based on the information inputted in the areas G11 to G15.

The setting information for attachment operation can be set when the attachment control mode is on. When the attachment control mode is turned on/off, an operation result is outputted to the processor 18C. The processor 18C outputs the setting information having been changed to the pump controller 16, the engine controller 17 and the communication terminal 19, and the operation result is stored in storage 18D. In the attachment control mode, a service person can perform the setting on a service screen accessible by inputting a password or the like. In the attachment control mode, a pressure and a flow rate required to actuate the attachment can be set and a plurality of such settings are stored. When the attachment control mode is turned on, the settings of pressure and flow rate become effective.

As shown in FIG. 3, the processor 18C of the multimonitor 18 receives through the network N2 detection data, such as the hydraulic oil temperature, the hydraulic pressure and the hydraulic oil flow rate, outputted from the pump controller 16. The processor 18C also receives through the network N2 detection data, such as the cooling water temperature, the residual fuel amount and the instant fuel consumption, outputted from the engine controller 17. Such detection data inputted to the processor 18C through the network N2 is stored in the storage 18D.

The processor 18C of the multimonitor 18 also acquires a working equipment operation state (i.e., a state where the working equipment 5 is actually actuated to work) based on the state of the control levers 12R, 12L outputted from the pump controller 16. Specifically, the working equipment operation state is determined when the detection value from the pressure sensor 12C, which detects the operation of the working element, is a predetermined detection value or higher. The processor 18C also acquires an attachment operation state (i.e., a state where the attachment is actually actuated to work), based on the operation signal from the attachment control lever 13A.

The work machine management apparatus or communication terminal 19, which outputs the setting information of the hydraulic excavator 1 and other various information to an external management server 20 (i.e., an external server) externally located, includes a processor 19A, a storage 19B and a communication unit 19C. The various information, which includes an integrated value of fuel consumption (e.g., an accumulated operation time of the engine 11A), is transmitted from the communication terminal 19 at regular intervals (e.g., once a day). Further, when any abnormality in the vehicle body or any specific state change according to the invention occurs, the communication terminal 19 transmits information immediately upon the occurrence.

The processor 19A generates, as the setting information and operation information of the hydraulic excavator 1, the detection data outputted from each of the pump controller 16 and the engine controller 17 and the information outputted from the multimonitor 18, which contains the working equipment operation state, the attachment operation state, and the fuel consumption information and setting information of the time when the attachment and the working equipment 5 are in operation. The generated information is stored in a predetermined storage area in the storage 19B.

The information output unit or communication unit 19C externally outputs the setting information and operation information of the hydraulic excavator 1 having been stored in the storage 19B to a base station 21 through a communication network (e.g., a satellite communication network or a mobile communication network). Such an external output is performed as needed, for instance, when the hydraulic excavator 1 is started or stopped or when any change occurs in the setting information of the hydraulic excavator 1.

The setting information and operation information of the hydraulic excavator 1 outputted from the communication unit 19C is received by the base station 21 and outputted to a communication device 23 of the management server 20 through a network 22.

The management server 20 includes an I/O unit 20A, a processor 20B and a storage 20C. The setting information and operation information of the hydraulic excavator 1 is inputted to the I/O unit 20A, processed by the processor 20B including a CPU, and stored in the storage 20C including a hard disk or an involatile memory.

The management server 20 is configured to collect the setting information and operation information of each of a plurality of hydraulic excavators 1 (i.e., hydraulic excavators including the hydraulic excavator 1). The collected operation information of each of the plurality of hydraulic excavators 1 indicates how the ongoing operation of each of the hydraulic excavators 1 is performed.

The network 22 is connectable to a terminal unit 24, so that a service person of a manufacturer or the like can access the operation information of the hydraulic excavator 1 stored in the management server 20 by operating the terminal unit 24 to provide a needed service to the hydraulic excavator 1.

Figure 5:
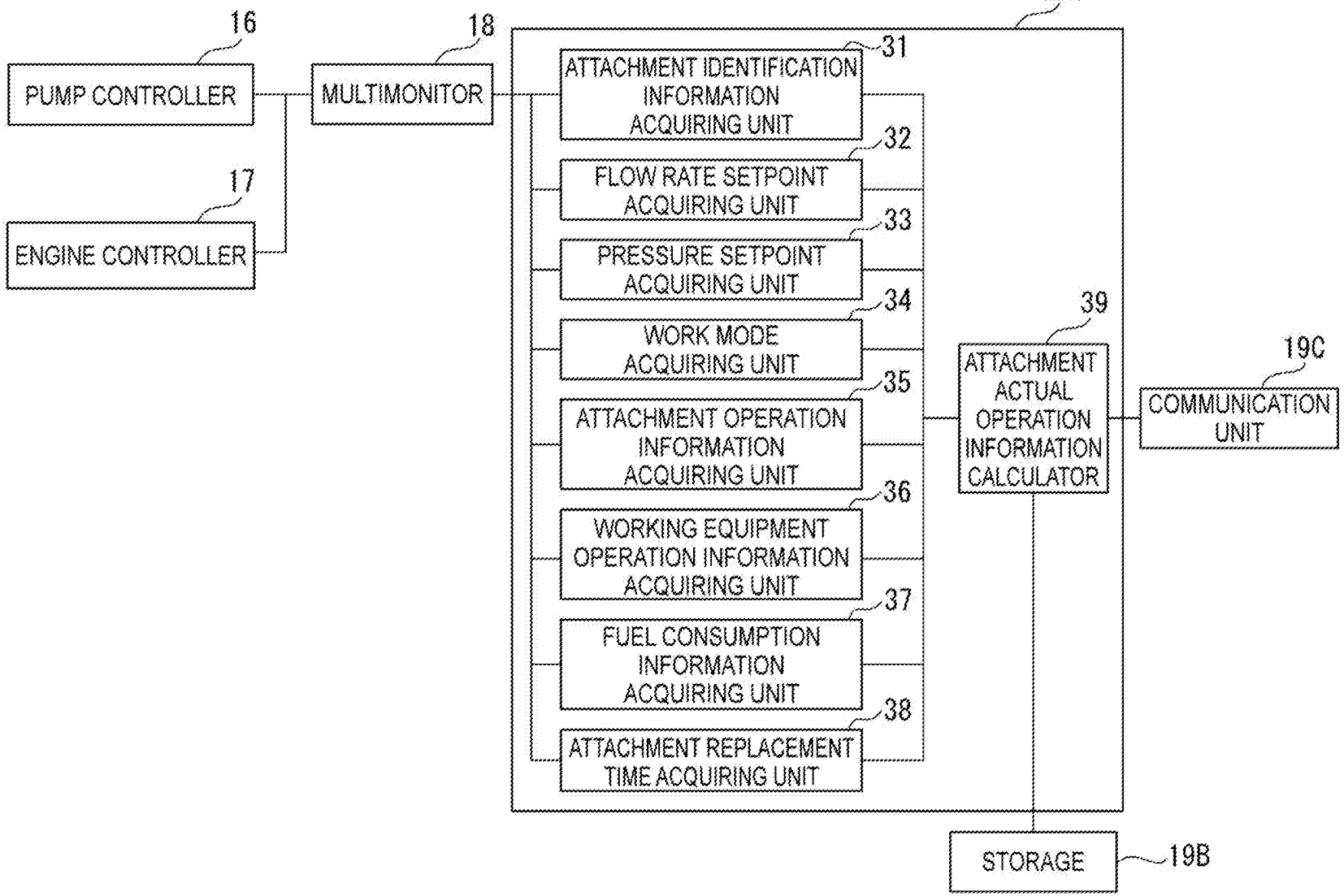
FIG. 5 is a block diagram showing the work machine management apparatus according to the exemplary embodiment.

FIG. 5 shows a functional block diagram of the processor 19A of the communication terminal 19.

The processor 19A includes an attachment identification information acquiring unit 31, a flow rate setpoint acquiring unit 32, a pressure setpoint acquiring unit 33, a work mode acquiring unit 34, an attachment operation information acquiring unit 35, a working equipment operation information acquiring unit 36, a fuel consumption information acquiring unit 37, an attachment replacement time acquiring unit 38, and an attachment actual operation information calculator 39 serving as a working element actual operation information calculator.

The attachment identification information acquiring unit 31, which serves as a working element identification information acquiring unit, acquires the attachment identification information outputted from the multimonitor 18 and determines which one of the breaker 8, a grabber, a cutter and the like is attached to the hydraulic excavator 1 as the attachment. The attachment identification information, the flow rate setpoint and the pressure setpoint may be changed as needed and, for instance, may be inputted in advance by a service person or the like.

It should be noted that the setting for each attachment is differentiated such that a high pressure is set for the use of an attachment for crushing (e.g., the breaker 8) as compared with other attachments such as an attachment for grabbing an object (e.g., a grabber), a tiltable attachment (e.g., a tilt bucket) and the like. The setting values thus depend on an attachment type.

The flow rate setpoint acquiring unit 32 acquires the flow rate setpoint information (i.e., the possible maximum flow rate of the pump 11 to the breaker 8), which has been inputted at the area G15 in the multimonitor 18 and outputted from the multimonitor 18.

The pressure setpoint acquiring unit 33 acquires the pressure setpoint information of the electromagnetic variable relief valve 15, which has been inputted at the area G14 in the multimonitor 18 and outputted from the multimonitor 18.

It should be noted that the pressure setpoint acquiring unit 33 does not acquire the pressure setpoint information when a control state of the attachment outputted from the multimonitor 18 is determined to be off.

The work mode acquiring unit 34, which serves as an attachment work mode acquiring unit, acquires an on/off state of the attachment control mode and attachment work mode information indicating the work mode assigned to the attachment, which have been outputted from the multimonitor 18. It should be noted that the attachment work mode in the exemplary embodiment, which has been inputted at the area G11 in the multimonitor 18, means a work mode set for the use of the attachment and includes two modes such as a power mode and an economy mode.

The attachment operation information acquiring unit 35, which serves as a working element operation information acquiring unit, acquires attachment operation information outputted from the multimonitor 18. In the exemplary embodiment, the attachment operation information acquiring unit 35 acquires the operation information of the breaker 8. The operation information contains, for instance, the started-to-be-selected date and time of the attachment, the ended-to-be-selected date and time of the attachment, an attachment actual operation duration when the attachment is actually actuated, and an actual operation fuel consumption spent when the attachment is actually actuated.

The working equipment operation information acquiring unit 36 acquires the working equipment operation state of the working equipment 5 outputted from the multimonitor 18. The working equipment operation information contains, for instance, the actual operation duration of the working equipment 5 when the working elements except the attachment are actually in operation under the working equipment operation state, and the actual operation fuel consumption of the working equipment 5. The working equipment operation information is included in the operation information.

The fuel consumption information acquiring unit 37 acquires the instant fuel consumption information of the engine 11A outputted from the multimonitor 18.

The attachment replacement time acquiring unit 38 acquires the date and time of replacing the attachment. Specifically, the attachment replacement time acquiring unit 38 acquires, as the started-to-be-selected date and time, the timing of when a specific work mode registration number corresponding to the use of the attachment is selected on the multimonitor 18 and acquires, as the ended-to-be-selected date and time, the timing of when a different work mode registration number corresponding to the use of any other attachment is selected.

The attachment actual operation information calculator 39, which serves as a working element actual operation information calculator, performs calculations when the attachment control mode is on. Specifically, the attachment actual operation information calculator 39 calculates, based on the actual operation duration of the breaker 8 acquired by the attachment replacement time acquiring unit 38 and the instant fuel consumption of the engine 11A acquired by the fuel consumption information acquiring unit 37, the actual operation fuel consumption of the breaker 8 spent when the breaker 8 is actually in operation.

Further, the attachment actual operation information calculator 39 calculates, based on the actual operation of the working elements except the attachment and the instant fuel consumption of the engine 11A, the actual operation duration and actual operation fuel consumption of the working equipment 5 at the time when the working equipment 5 is actually in operation.

The attachment actual operation information calculator 39 stores in the storage 19B the acquired setting information, the operation information containing the attachment actual operation duration and actual operation fuel consumption, and the actual operation duration and actual operation fuel consumption of the working equipment 5.

Further, the attachment actual operation information calculator 39 determines whether or not the work mode registration number inputted from the multimonitor 18 has been changed. If the work mode registration number has been changed, the attachment actual operation information calculator 39 determines that the timing for the communication unit 19C to start communication has come. Accordingly, the information having been stored in the storage 19B, which includes the operation information added with the started-to-be-selected date and time and the ended-to-be-selected date and time of the attachment acquired by the attachment replacement time acquiring unit 38, is outputted to the communication unit 19C. The communication unit 19C outputs the setting information and the operation information to the management server 20.

[4] Implementation of Exemplary Embodiment

Figure 6:
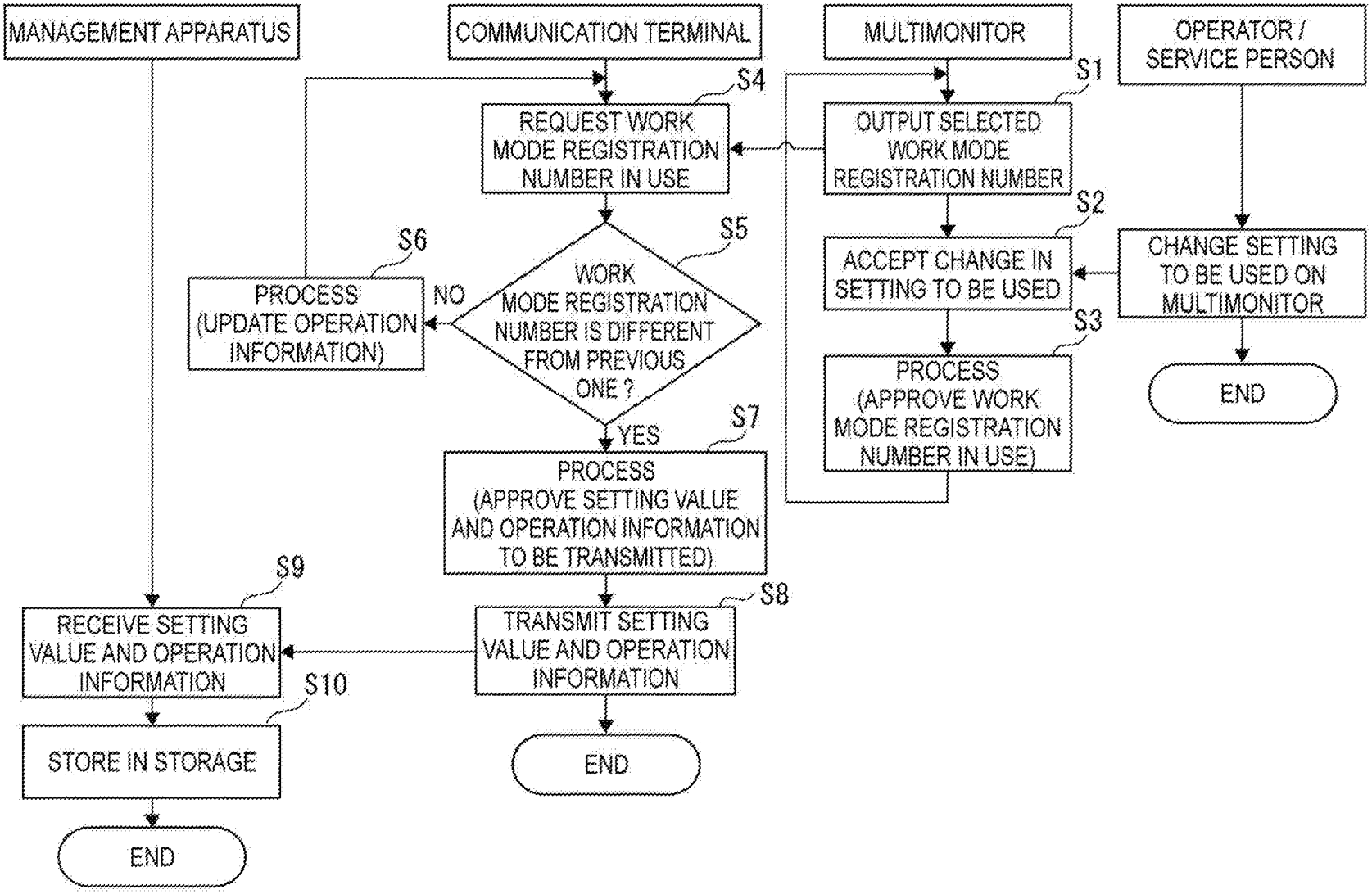
FIG. 6 is a flowchart for showing an operation according to the exemplary embodiment.

Next, implementation of the exemplary embodiment will be described with reference to a flowchart shown in FIG. 6.

The processor 18C of the multimonitor 18 outputs the currently selected work mode registration number to the communication terminal 19 at regular intervals (Step S1).

When an operator changes the setting of the work mode registration number by operating the button 18B of the multimonitor 18, the processor 18C accepts the setting change of the work mode registration number (Step S2).

The processor 18C performs a process for approving the setting change based on the selected work mode registration number (Step S3).

The processor 19A of the communication terminal 19 receives the work mode registration number outputted from the multimonitor 18 at the regular intervals (Step S4).

The processor 19A determines whether or not the work mode registration number received at the regular intervals is the same as one previously received (Step S5).

If the registration number is the same as the previous one (S5: No), the processor 19A updates the attachment operation information and the working equipment operation information (Step S6).

Specifically, updating the attachment operation information includes updating the attachment actual operation duration and actual operation fuel consumption and updating the working equipment operation information includes the update of the actual operation duration and actual operation fuel consumption of the working equipment 5. It should be noted that the updated operation information is not transmitted to the management server 20.

If the registration number is different from the previous one (S5: Yes), the processor 19A generates output information containing the changed registration number (Step S7).

The communication unit 19C transmits update information containing the changed work mode registration number through a communication line, the base station 21 and the network 22 (Step S8). It should be noted that the working equipment operation information is not transmitted to the management server 20 at this time unless the working equipment operation information is accumulated.

The I/O unit 20A of the management server 20 receives the update information outputted from the communication terminal 19 through the communication device 23 (Step S9). The update information is subjected to a predetermined process by the processor 20B and then stored in the storage 20C (Step S10).

[5] Advantage(s) and Effect(s) of Exemplary Embodiment

According to the exemplary embodiment, the management server 20 is configured to acquire the information of when the breaker 8 (attachment) is in use, such as the flow rate setpoint of the hydraulic pump 11, the pressure setpoint of the electromagnetic variable relief valve 15 and the attachment actual operation duration. Consequently, since such an attachment actual operation state is recognized, a frequency of a load applied to the hydraulic excavator 1 depending on the operation state of the breaker 8 can be recognized. An owner of the hydraulic excavator 1 or a service person can thus determine a time for maintenance.

In addition, since the actual operation fuel consumption is simultaneously acquired at this time, a fuel consumption spent during the operation using the breaker 8 can also be recognized.

Further, since the on/off state of the attachment control mode and the attachment identification information are acquired, it can be recognized that an attachment different from the breaker 8 is attached. The frequency of attachment replacement and the frequency of attachment operation can thus be recognized.

Since the attachment identification information, the flow rate setpoint of the hydraulic pump 11 and the pressure setpoint of the electromagnetic variable relief valve 15 are acquired, it can be determined that an attachment is not suitably used, for instance, when the pressure setpoint of the electromagnetic variable relief valve 15 is set high though an attachment not requiring a high pressure setpoint of the electromagnetic variable relief valve 15 (i.e., an attachment different from the breaker) is in use.

Further, since the attachment work mode for the use of the attachment is recognized, the work mode set when the attachment is used can be correspondingly recognized.

A service person of the manufacturer or the like can thus recognize the operation state of the attachment stored in the management server 20 using the terminal unit 24 and give advice about a flow rate setpoint, a pressure setpoint and an attachment work mode suitable for the use of the attachment.

Further, since the attachment operation information and the working equipment operation information of the working equipment 5 are simultaneously acquired, the operation state of the hydraulic excavator 1 as a whole, which includes the working equipment 5 and the breaker 8, can be recognized. Consequently, the proportion of an operation time when the attachment is in use to an operation time when the working equipment 5 is in use can be recognized. This allows for determining whether the attachment is suitably used for the work and/or recognizing a load of the work as a whole on the hydraulic excavator 1.

Second Exemplary Embodiment

Next, a second exemplary embodiment of the invention will be described. It should be noted that the components or the like that have been described above will be denoted by the same reference numerals and the description thereof will be omitted in the following description.

In the first exemplary embodiment, the communication terminal 19 receives the registration number of the selected work mode at the regular intervals and transmits, in response to a change in the registration number, the update information containing the registration number to the management server 20.

In contrast, the second the exemplary embodiment is different in that the update information is transmitted to the management server 20 in response to a change in the setting of any one of the on/off of the attachment control mode, the attachment identification information and the attachment preset number.

Specifically, the processor 18C of the multimonitor 18 provides a sequence key corresponding to the setting information, and the sequence key is stored in the storage 18D. The sequence key is updated when the setting information is updated.

The communication terminal 19 receives the sequence key from the multimonitor 18 at regular intervals. When the sequence key is updated, the communication terminal 19 updates the setting information having been stored in the storage 19B to the setting information newly stored by the multimonitor 18. The communication terminal 19 also transmits the setting information to the management server 20 when the sequence key is updated.

Figure 7:
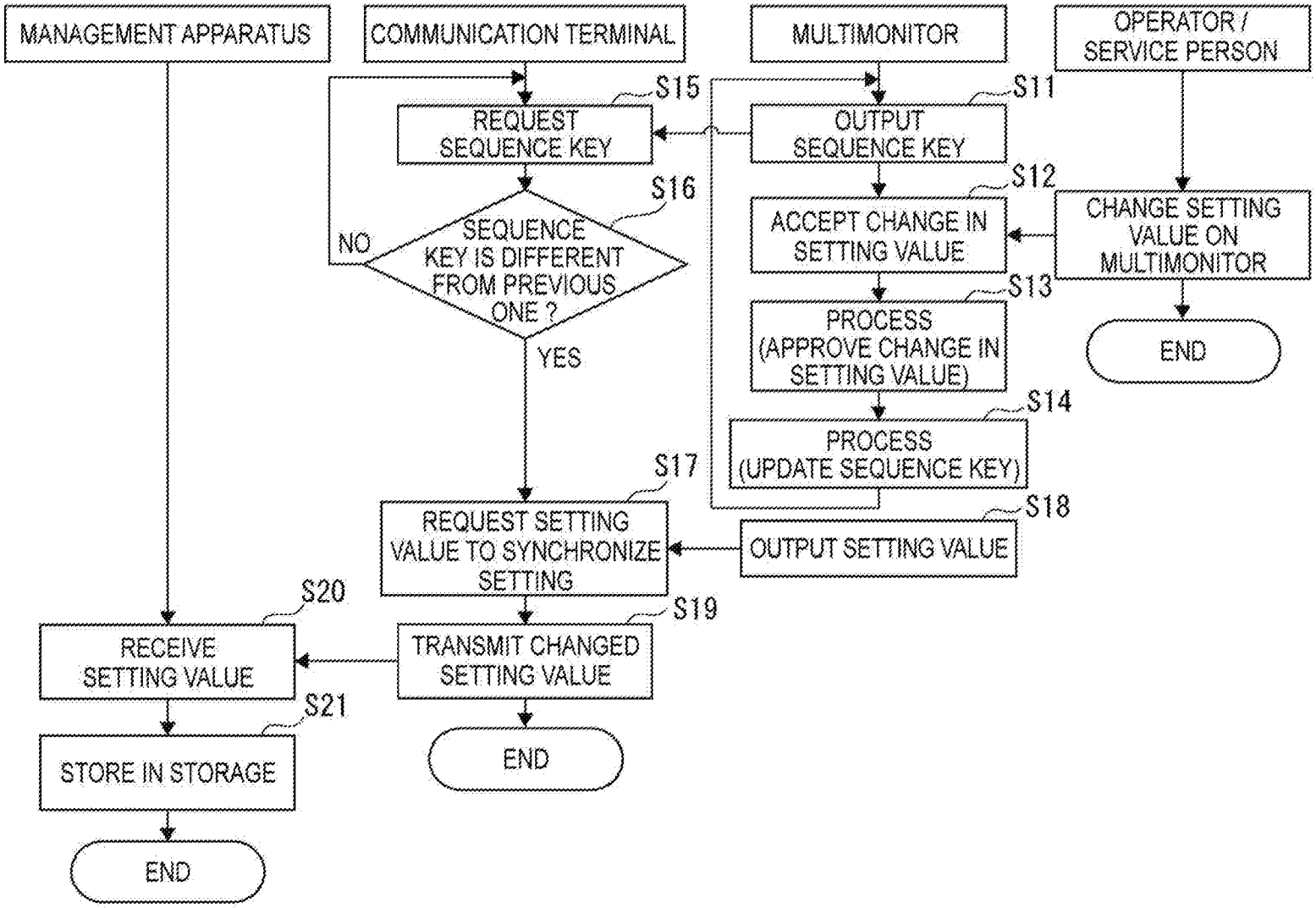
FIG. 7 is a flowchart for showing an operation of a work machine management apparatus according to a second exemplary embodiment of the invention.

Implementation of the second exemplary embodiment will be described with reference to a flowchart shown in FIG. 7.

The processor 18C of the multimonitor 18 outputs the currently set sequence key to the communication terminal 19 at the regular intervals (Step S11).

Incidentally, the sequence key is changed when the setting value such as the attachment name, the flow rate setpoint and the pressure setpoint is changed. Specifically, as shown in FIG. 4, when the image G1 is displayed on the screen 18A of the multimonitor 18, the sequence key is changed in response to a change in the setting value in any one of the area G13 to the area G15 irrespective of a change in the work mode registration number in the area G12.

When an operator changes the setting value in any one of the area G13 to the area G15 by operating the button 18B of the multimonitor 18, the processor 18C accepts the change in the setting (Step S12).

The processor 18C, in response to the change in the setting value, performs a process for approving the setting change (Step S13) and updates the sequence key (Step S14).

The processor 19A of the communication terminal 19 receives the sequence key outputted from the multimonitor 18 at the regular intervals (Step S15).

The processor 19A determines whether or not the sequence key received at the regular intervals is the same as one previously received (Step S16).

If the sequence key received at the regular intervals is the same as the previous one (S16: No), the process returns to Step S15.

If the sequence key is different from the previous one (S16: Yes), the processor 19A requests the multimonitor 18 to output the setting value in order to synchronize the setting (Step S17). The multimonitor 18 outputs the setting value in response to the request from the communication terminal 19 (Step S18).

The communication unit 19C transmits setting information containing the changed setting value to the management server 20 through a communication line, the base station 21 and the network 22 (Step S19).

The I/O unit 20A of the management server 20 receives the setting information outputted from the communication terminal 19 through the communication device 23 (Step S20). After being subjected to a predetermined process by the processor 20B, the new setting information is stored in the storage 20C (Step S21).

In the second exemplary embodiment, the setting information for the operation of the attachment of the hydraulic excavator 1 can be received by the communication terminal 19 and the management server 20. Consequently, for instance, the setting indicating that the attachment is in an overloaded operation can be recognized on the side of the management server 20. It should be noted that information may be transmitted to the management server 20 in the second exemplary embodiment in the same manner as in any other exemplary embodiment.

Third Exemplary Embodiment

Next, a third exemplary embodiment of the invention will be described.

In the first exemplary embodiment, the flow rate setpoint of the pump-flow control unit 14 and the pressure setpoint of the electromagnetic variable relief valve 15 corresponding to the work mode registration number selected by an operator using the button 18B of the multimonitor 18 are acquired to generate the attachment operation information.

In contrast, in the third exemplary embodiment, a swashplate sensor 11C is provided to the hydraulic pump 11 of the hydraulic circuit of the hydraulic system 10 and pressure sensors 13B, 13C are provided in a pipe leading from the attachment valve 13 to the attachment cylinder 8C, as shown in FIG. 8.

The third exemplary embodiment is different in that the processor 19A of the communication terminal 19 acquires a maximum flow rate of the hydraulic oil detected by the swashplate sensor 11C and a maximum pressure detected by the pressure sensors 13B, 13C during a period from the started-to-be-selected date and time (i.e., the date and time when the use of the attachment is started) to the ended-to-be-selected date and time (i.e., the date and time when the use of the attachment is ended).

As shown in FIG. 8, the hydraulic system 10 is the same as that of the first exemplary embodiment except that the swashplate sensor 11C is provided in the vicinity of the hydraulic pump 11. Further, the pressure sensors 13B, 13C, which are provided in the pipe leading from the attachment valve 13 to the attachment cylinder 8C near the bottom and head, output individual detection values to the pump controller 16.

As shown in FIG. 9, the pump controller 16 includes a maximum pressure determining unit 161 and a swashplate angle determining unit 162.

Pressure values of the attachment cylinder 8C detected by the pressure sensors 13B, 13C are inputted to the maximum pressure determining unit 161.

A value of a swashplate angle of the hydraulic pump 11 detected by the swashplate sensor 11C is inputted to the swashplate angle determining unit 162.

The maximum pressure determining unit 161 outputs, as the maximum pressure, a pressure value inputted during the period from the started-to-be-selected date and time (i.e., the date and time when the use of the attachment is started) to the ended-to-be-selected date and time (i.e., the date and time when the use of the attachment is ended) to the multimonitor 18. The swashplate angle determining unit 162 outputs, as the maximum flow rate, a value of the swashplate angle inputted during the period from the started-to-be-selected date and time (i.e., the date and time when the use of the attachment is started) to the ended-to-be-selected date and time (i.e., the date and time when the use of the attachment is ended) to the multimonitor 18. It should be noted that the maximum pressure and the maximum flow rate acquired by the maximum pressure determining unit 161 and the swashplate angle determining unit 162 are reset when the use of the attachment is ended.

Regarding determination of the maximum pressure, it should be noted the maximum of the detection values detected by the pressure sensors 13B, 13C during the operation of the attachment is outputted as the maximum pressure. It should also be noted that the maximum pressure, which is one of the values detected by the pressure sensors 13B, 13C, may fall below the pressure setpoint set by the multimonitor 18 depending on the operation state.

The maximum flow rate is determined in the same manner as the maximum pressure. Specifically, the maximum flow rate is detected based on the swashplate angles detected by the swashplate sensor 11C.

As shown in FIG. 9, the maximum flow rate and the maximum pressure inputted to the multimonitor 18 are outputted to the processor 19A of the communication terminal 19 to be inputted respectively to the maximum flow rate acquiring unit 32A and the maximum pressure acquiring unit 33A of the processor 19A.

If the work mode registration number is not changed, the attachment actual operation information calculator 39 acquires the maximum flow rate of the hydraulic pump 11 acquired by the maximum flow rate acquiring unit 32A and the maximum pressure of the electromagnetic variable relief valve 15 acquired by the maximum pressure acquiring unit 33A. If the work mode registration number is changed, the attachment actual operation information calculator 39 determines the maximum flow rate of the hydraulic pump 11 acquired by the maximum flow rate acquiring unit 32A and the maximum pressure of the electromagnetic variable relief valve 15 acquired by the maximum pressure acquiring unit 33A. The attachment actual operation information calculator 39 then calculates attachment actual operation information based on the determined maximum pressure and maximum flow rate.

The third exemplary embodiment provides advantages and effects identical to the ones described above.

Further, in the third exemplary embodiment, the attachment actual operation information is calculated based on the actual maximum flow rate of the pump 11 and maximum pressure of the electromagnetic variable relief valve 15. Since a load on the vehicle body is determined under a condition close to the actual operation condition, the attachment actual operation information can be calculated with a higher accuracy.

Modification(s) of Exemplary Embodiment(s)

Incidentally, it should be understood that the scope of the invention is not limited to the above-described exemplary embodiment(s) but includes modifications and improvements as long as an object(s) of the invention can be achieved.

In the above exemplary embodiment(s), the breaker 8 is used as the attachment but the invention is not limited thereto. For instance, the invention may be applied even when any other attachment such as a grabber and a cutter is attached to the hydraulic excavator 1.

In the above exemplary embodiment(s), the invention is applied to the crawler hydraulic excavator 1 but is not limited thereto. The invention may be applied to a wheel hydraulic excavator or the like.

In the exemplary embodiment(s), the communication terminal 19 is used as the work machine management apparatus but the invention is not limited thereto. For instance, a device to be operated in the cab 4 such as the multimonitor 18 or a controller such as the pump controller 16 and the engine controller 17 may be used as the management apparatus. Further, the management server 20 or a communication device added with a communication function for receiving information outside the vehicle may be used as the management apparatus.

Further, the communication unit 19C of the communication terminal 19 functions as the information output unit and outputs the setting change information to the management server 20, but the invention is not limited thereto. The setting change information may be displayed on the screen 18A of the multimonitor 18.

The multimonitor 18 is used as the display in the above description but, alternatively, a monitor without an input function (e.g., a button) but merely with a display function may be used.

Additionally, any specific structure, shape and the like according to the invention may be changed as long as an object(s) of the invention can be achieved.

The invention claimed is:

1. A work machine management apparatus for a work machine, the work machine comprising:

a work machine body comprising a carriage; and working equipment comprising a plurality of working elements movably connected to the work machine body, the working elements comprising at least one working element replaceable with a different working element among the working elements, the work machine management apparatus comprising:

a working element identification information acquiring unit configured to acquire working element identification information indicating whether or not the replaceable working element is replaced with the different working element;

a storage configured to store flow rate setpoints and pressure setpoints of hydraulic oil for respective types of the working elements;

a flow rate setpoint acquiring unit configured to acquire, from the storage, a flow rate setpoint of the hydraulic oil for the different working element identified by the working element identification information;

a pressure setpoint acquiring unit configured to acquire, from the storage, a pressure setpoint of the hydraulic oil for the different working element;

a working element operation information acquiring unit configured to acquire operation information of the different working element; and a working element actual operation information calculator configured to calculate actual operation information comprising an actual operation duration of the different working element based on the information acquired by each of the working element identification information acquiring unit, the flow rate setpoint acquiring unit, the pressure setpoint acquiring unit, and the working element operation information acquiring unit.

2. The work machine management apparatus according to claim 1, further comprising an information output unit configured to output the actual operation information of the different working element calculated by the working element actual operation information calculator.

3. The work machine management apparatus according to claim 2, wherein the working element actual operation information calculator is configured to calculate an integrated value of an actual operation fuel consumption of the different working element as the actual operation information of the different working element.

4. The work machine management apparatus according to claim 2, wherein the working elements of the working equipment comprise an attachment and a working element different from the attachment, the work machine management apparatus further comprises a working equipment operation information acquiring unit configured to acquire operation information of the working element different from the attachment, and the information output unit is configured to output actual operation information of the attachment and actual operation information of the working element different from the attachment.

5. The work machine management apparatus according to claim 4, further comprising an attachment work mode acquiring unit configured to acquire an attachment work mode assigned to the attachment, wherein the information output unit is configured to output the acquired attachment work mode.

6. The work machine management apparatus according to claim 4, wherein the information output unit is configured to output the actual operation information of the attachment and the actual operation information of the working element different from the attachment to an external server.

7. The work machine management apparatus according to claim 2, wherein the flow rate setpoint acquiring unit and the pressure setpoint acquiring unit are configured to respectively acquire the flow rate setpoint and the pressure setpoint at regular intervals, and information output unit is configured to output the actual operation information of the different working element in response to an update of either the flow rate setpoint and or the pressure setpoint.

8. A work machine management apparatus for a work machine, the work machine comprising:

a work machine body comprising a carriage; and working equipment comprising a plurality of working elements movably connected to the work machine body, the working elements comprising at least one working element replaceable with a different working element, the work machine management apparatus comprising:

a working element identification information acquiring unit configured to acquire working element identification information indicating whether or not the replaceable working element is replaced with the different working element;

a maximum flow rate acquiring unit configured to acquire a detection value of a maximum flow rate of hydraulic oil during a period from a start to an end of a use of the different working element;

a maximum pressure acquiring unit configured to acquire a maximum pressure of the hydraulic oil during the period from the start to the end of the use of the different working element;

a working element operation information acquiring unit configured to acquire operation information of the different working element; and a working element actual operation information calculator configured to calculate actual operation information comprising an actual operation duration of the different working element based on the information acquired by each of the working element identification information acquiring unit, the maximum flow rate acquiring unit, the maximum pressure acquiring unit, and the working element operation information acquiring unit.

9. The work machine management apparatus according to claim 8, further comprising an information output unit configured to output the actual operation information of the different working element calculated by the working element actual operation information calculator.

10. The work machine management apparatus according to claim 9, wherein the working element actual operation information calculator is configured to calculate an integrated value of an actual operation fuel consumption of the different working element as the actual operation information of the different working element.

11. The work machine management apparatus according to claim 9, wherein the working elements of the working equipment comprise an attachment and a working element different from the attachment, the work machine management apparatus further comprises a working equipment operation information acquiring unit configured to acquire operation information of the working element different from the attachment, and the information output unit is configured to output actual operation information of the attachment and actual operation information of the working element different from the attachment.

12. The work machine management apparatus according to claim 11, further comprising an attachment work mode acquiring unit configured to acquire an attachment work mode assigned to the attachment, wherein the information output unit is configured to output the acquired attachment work mode.

13. The work machine management apparatus according to claim 11, wherein the information output unit is configured to output the actual operation information of the attachment and the actual operation information of the working element different from the attachment to an external server.

14. The work machine management apparatus according to claim 9, wherein the maximum flow rate acquiring unit and the maximum pressure acquiring unit are configured to respectively acquire the maximum flow rate and the maximum pressure at regular intervals, and the information output unit is configured to output the actual operation information of the different working element in response to an update of either the maximum flow rate and or the maximum pressure.

15. The work machine management apparatus according to claim 8, wherein the maximum pressure acquiring unit is configured to acquire a detection value of the maximum pressure of the hydraulic oil.

* * * * *